US005376177A

United States Patent [19]

Elvidge et al.

[11] Patent Number: 5,376,177

[45] Date of Patent: Dec. 27, 1994

[54] COAT WEIGHT PROFILING

[75] Inventors: David R. Elvidge; Malcolm K. Smith, both of North Vancouver, Canada

[73] Assignee: MacMillan Bloedel Limited, Vancouver, Canada

[21] Appl. No.: 103,381

[22] Filed: Aug. 9, 1993

[51] Int. Cl.[5] ..... B05C 3/02

[52] U.S. Cl. ..... 118/410; 118/413; 118/419

[58] Field of Search ..... 118/410, 413, 419, 688; 427/434.2, 439

[56] References Cited

U.S. PATENT DOCUMENTS 4,250,211 2/1981 Damrau et al. .
4,396,648 8/1983 Holt et al. ..... 118/413
4,706,603 11/1987 Wohlfeil .
4,839,201 6/1989 Rantanen et al. ..... 118/413
5,078,081 1/1992 Kustermann .
5,133,281 7/1992 Eriksson ..... 118/412
5,192,591 3/1993 Chance ..... 118/413

FOREIGN PATENT DOCUMENTS 2040845 10/1991 Canada .
WO9309290 5/1993 WIPO .

*Primary Examiner*—W. Gary Jones
*Assistant Examiner*—Brenda Adele Lamb
*Attorney, Agent, or Firm*—C. A. Rowley

[57] ABSTRACT

The amount of coating applied by an applicator is locally adjusted by locally disturbing the flow to the metering outlet, for example, by locally bleeding selected amounts of coating from the metering chamber of the coater to thereby controllably profile the amount of coating applied.

10 Claims, 4 Drawing Sheets

COAT WEIGHT PROFILING

FIELD OF THE INVENTION

Present invention relates to a coater, more specifically, the present invention relates to a system for cross machine profiling the coat weight of a coating applied by a coater.

BACKGROUND OF THE PRESENT INVENTION

A number of different types of coating systems are available for coating paper webs wherein the coating is applied either to a roll or directly to a paper sheet or the like from a coating chamber opening onto the roll or sheet and having a metering device at the downstream end of the chamber. The metering device generally consists of a blade (i.e. a blade coater) or a rod (metering rod coater). The rod coater uses a rod which may have a contoured surface to meter the amount of coating based, for example, on the size of grooves formed in the rod or in some cases, by using a relatively smooth rod.

To transversely (cross machine) profile, i.e. locally adjust the amount of coating applied at different locations across the machine, it is known to physically deform the blade and/or rod at spaced locations along the blade or rod. Rods are significantly stiffer than blades and thus, are limited in the amount of adjustment that can be made. As the diameter of the rod increases, so does its stiffness which thereby further limits the amount of deformation to which it may reasonably be subjected.

U.S. Pat. No. 4,250,211 issued Feb. 10, 1981 to Damrau, describes a short dwell coater for applying a coating directly to a paper web while permitting uniform bleeding of coating at the upstream side of the coater well to form an air seal at the paper incoming side of the coater.

U.S. Pat. No. 4,706,603 issued Nov. 17, 1987 to Wohlfeil and U.S. Pat. No. 5,078,081 issued Jan. 7, 1992 to Kustermann, shows a coating apparatus with variable area bleed holes all of which are simultaneously adjusted to vary coat weight.

Canadian published application, 2,040,845, published Oct. 20, 1991, inventor, Rantanen, discloses a rod-type coater wherein a large smooth rod is used and wherein its effective flexibility is increased by utilizing different rod structure (hollow) so that the rod may be more easily deflected to permit cross machine direction (CD) profiling of the coating relative to the roll or web being coated.

When metering is performed by a blade, it is possible to profile sections about 7 cm wide by locally deforming the blade. However, with the rod, whether grooved or smooth, profiling is more difficult and is confined to wide sections depending on the stiffness of the rod. It has been found that a conventional rod of about 1 cm in diameter can be deformed for profiling over a length of about 20 cm. But as the diameter of the rod is increased, say to, 3.5 cm, the minimum section length over which it can be deformed is about 50 cm.

PCT patent application, WO93/09290 published on May 13, 1993, discloses yet another form of short-dwell coater wherein a shoe is biased against the web by the pressure of the coating fluid.

BRIEF DESCRIPTION OF THE PRESENT INVENTION

It is the object of the present invention to provide a coater to facilitate cross-machine profiling of coating weight applied.

Broadly, the present invention relates to a coating applicator for applying a coating to a moving surface said applicator comprising a chamber, a first outlet from said chamber opening towards said surface, an outlet passage at the downstream end of said first outlet, a metering means defining one side of said outlet passage, flow disturbing means, means for selectively locally adjusting said flow disturbing means to change fluid flow in said chamber at locations spaced transversely of said surface, said flow disturbing means positioned upstream of said metering means a distance sufficiently short that local disturbances in flow in said chamber caused by said flow disturbing means are not dissipated before said coating flows from said chamber past said metering means.

Preferably, said applicator will further include a bleed outlet at the upstream side of said first outlet, said bleed outlet permitting flow rearward relative to the direction of movement of said surface past said applicator to form an air seal at the upstream end of said first outlet to inhibit entrainment of air into said first outlet.

Preferably, said bleed outlet will be formed between an upstream wall of said first outlet and said surface.

Preferably, said local flow disturbing means will be formed by fluid flow passages from said chamber and said means to adjust selectively adjusts flow through said passages.

Preferably, said bleed outlet and said fluid flow passage will be each formed in said upstream wall.

Broadly, the present invention relates to a coating applicator for applying coating to a moving surface said applicator comprising a chamber a first outlet from said chamber opening to said surface, metering means defining an outlet passage at the downstream end of said first outlet, a bleed outlet for bleeding coating from said chamber, means for locally adjusting the amount of coating flowing towards said metering means in said chamber thereby to vary locally transversely of said surface the amount of fluid locally passing said metering means and being retained by said surface.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
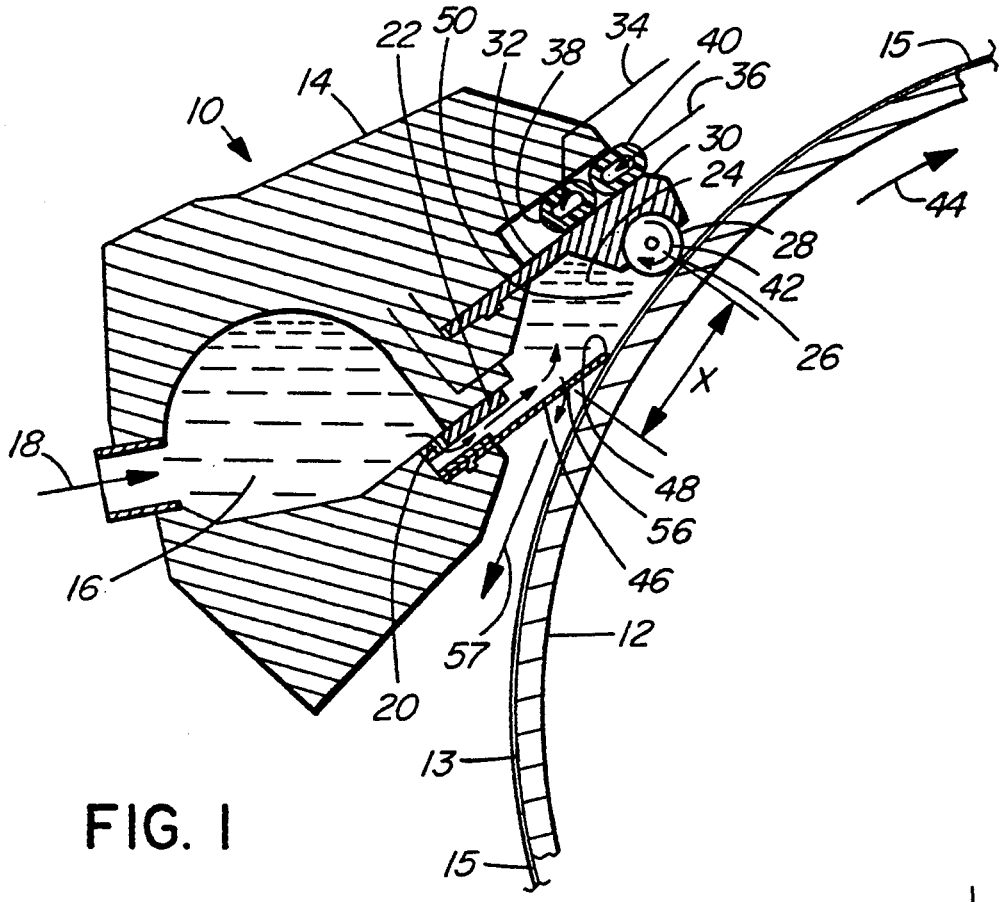
FIG. 1 is a section illustrating the main elements of one type of short-dwell coater.

As shown in FIG. 1, the coater 10 in the illustrated arrangement, applies a coating (not shown) onto a surface which may be formed by the periphery of a drum 12 which in the case of a size press application will carry the coating for application to a web that passes through a nip between the drum 12 and a second roll (not shown) but as described, for example, in the Canadian application, 2,040,845, referred to above. The coating may also be applied directly to the surface of the web to be coated, i.e. the web (schematically indicated at 15) would be carried on the surface 13 of the roll 12 past the coating head 14 where the coating will be applied directly onto exposed surface of the web such as the web of paper.

In either case, it is important that the amount of coating applied on the web be locally adjustable laterally of the web (i.e. across the web in the cross machine direction (CD)) to accommodate local variations in the web or substrate being coated. Paper is a nonuniform substrate that may have different formations (fiber arrangement) or different moisture contents at spaced locations laterally of the web so that the coating pickup or penetration in these areas may be different than in other areas of the web. Thus, the ability to adjust the coat weight applied in the selected areas is very beneficial. The prior techniques described above have not been very effective.

Referring back to FIG. 1, the coating head 14 has an inlet chamber 16 into which the coating formulation (coating fluid) is pumped as indicated by the arrow 18 and from which the coating passes via apertures 20 in a partition plate 22 to a metering chamber 24. Generally, there are plurality of apertures 20 at axially spaced locations relative to the roll 12 (i.e. in the CD) so as to substantially uniformly distribute the flow of coating formulation from the chamber 16 into the metering chamber 24.

A metering outlet 26 is formed at the downstream end of the metering chamber 24, in the illustrated arrangement, via a rod 28 on one side and the surface of the roll 12 (or web 15) on the other. The rod 28 may be a smooth rod or grooved rod or blade, etc. and will extend the length of the metering chamber 24, i.e. the length of the metering chamber 24 measured in the cross machine direction (CD), i.e. axially of the drum 12.

The metering rod 28 is rotatably mounted in a rod holder or the like 30 that is mounted from the applicator housing 14 via a resilient or flexible connecting band 32 so that loading pressures (e.g. pneumatic pressures) applied as indicated at 34 and 36 to flexible tubes 38 and 40 can adjust the pressure of the rod 28 toward the surface 13 of the roll 12.

Means (not shown) may be provided to locally deform the rod 28 and its holder 30 and thereby locally profile the size of the metering outlet 26 so that the amount of coating that is applied at discreet locations in the CD transversely (axially) of the drum 12 is varied. This type of profiling (as above indicated) is more useful in a blade coater as the blade is more flexible and can be locally adjusted over shorter increments than a rod such as rod 28.

In a rod coater, the metering rod such as rod 28 is rotated as indicated by the arrow 42 preferably in a direction opposite to the direction of movement of the surface 13 as indicated by the arrow 44. The rotation speed of the rod 28 is low (generally in the order of 0–100 rpm) so that surface of the rod 28 defining one side of the metering outlet 26 changes preferably continuously.

The upstream side of the metering chamber 24 is formed by an upstream wall 46 which in the illustrated arrangement is in the form of a blade (either sized or flexible as appropriate to the application), the free end of which indicated at 48 is in close proximity to the surface 13 of the drum 12 (or of the paper substrate 15 passing through the metering chamber).

It will be apparent that an outlet 50 from the metering chamber 24 is defined by the free edge 48 of the upstream wall 46 on the upstream side and the metering rod 28 defining one side of the metering outlet 26 on the downstream side.

Figure 2:
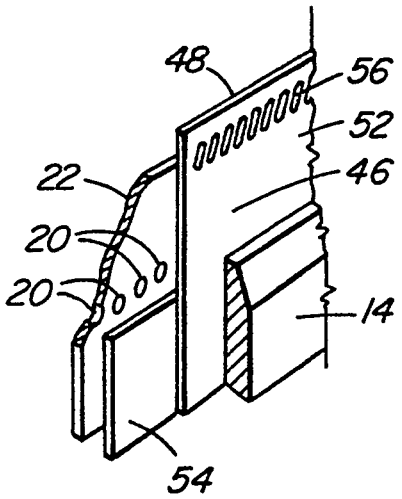
FIG. 2 is a partial isometric section illustrating the upstream wall configuration and the inlet to the metering chamber.

In the embodiment shown in FIG. 2, the upstream wall 46 is formed by a blade 52 having as its leading edge the free end 48.

The blade 52 is held in position between bar 54 and housing 14, and secured by a screw or clamping device.

A plurality of bleed holes 56 are provided through the blade 52 adjacent but spaced upstream of the edge 48. Coating is bled through these apertures and this bled coating forms a seal that seals the gap between the edge 48 and the surface 13 or the web (not shown) riding on the surface 13 to prevent the ingress of air into the chamber 24. This bleeding of coating fluid rearward relative to the direction of movement of the surface 13 to form a seal is important to the function of the device and it is important that the seal extend along the full effective length of the edge 48, i.e. the full effective length of the chamber 24 measured axially the drum 12. Thus, in all embodiments, the local change in bleed (as will be described below) must not impair the formation of the seal along the full length of the upstream end of the chamber 24.

In one conventional system, the slots 56 are substantially of uniform size and evenly distributed across the machine to provide a uniform opening for bleed of fluid along the effective length of the chamber 24 measured axially of the drum 12.

The present invention is based on the discovery that locally disturbing in the chamber 24 the flow of coating toward the metering outlet 26, for example, by locally varying the amount of coating bleed from the chamber 24 will affect the amount of coating that passes through the outlet 26 downstream of the area wherein flow is disturbed provided the distance between where the flow is disturbed and the outlet 26 is sufficiently short that disturbance has not been dissipated before the flow reaches the outlet 26.

Figure 3:
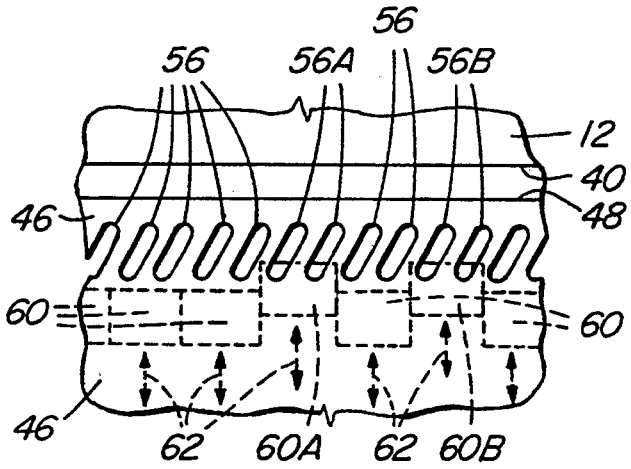
FIG. 3 is an illustration of a modification of the upstream wall of the coating chamber illustrating one embodiment of the present invention.

In the embodiment of FIG. 3, a plurality of movable elements 60 which may be adjusted backward and forward as schematically represented by the arrows 62 are shown mounted on the outside face of the blade 52 (or upstream wall 46) to selectively interfere with the flow (bleed) of coating through outlets 56. The elements 60 may be selectively moved as schematically indicated by the arrows 62, for example, hydraulically or by electric solenoids to cover selected portions of the openings of selected outlets 56, i.e. the element 60A has been moved to partially close the outlet 56A. Similarly, the element 60B has been moved into a position to partly close the outlet 56B. The other outlets 56 in the illustration remain essentially completely open.

This selective blocking of the outlets 56 obviously adjust the flow that will pass through the outlets that are partially or fully blocked off thereby disturbing the flow of the fluid locally within the chamber 24.

The length of the movable elements 60 measured in the CD, i.e. axially of the drum 12 will be at least 1 inch and generally less than 6 inches.

It is important that this local disturbance in the flow not be damped out by the time the flow reaches the outlet 26. Thus, it is important that the distance from the controllable outlets 56 to the metering outlet 26 be relatively short so any disturbance to the flow in chamber 24 caused by selectively varying the bleed through outlets 56 will not have been damped out before the coating fluid passes through the outlet 26. A distance X of less than 8 inches preferably less than 6 will operate satisfactorily. Obviously, the viscosity of the coating formulation and pressure in chamber 24 will affect the maximum spacing or distance X.

Figure 4:
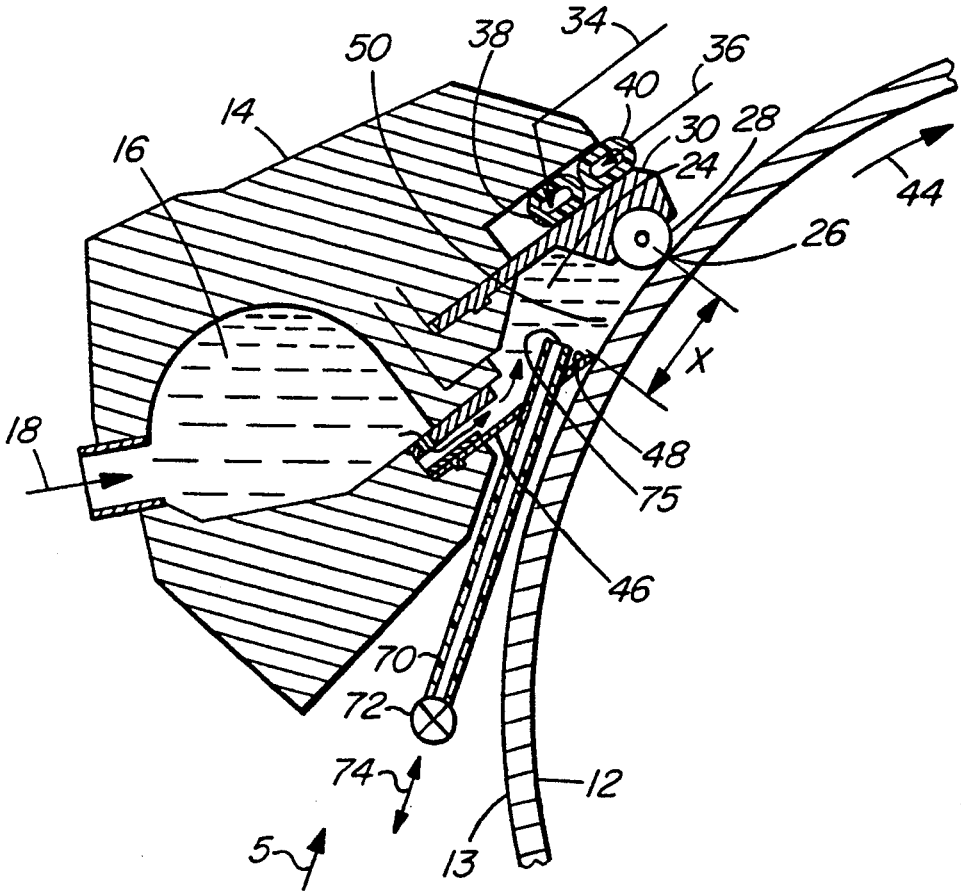
FIG. 4 is a section similar to FIG. 1 but showing a modification of the present invention.
Figure 5:
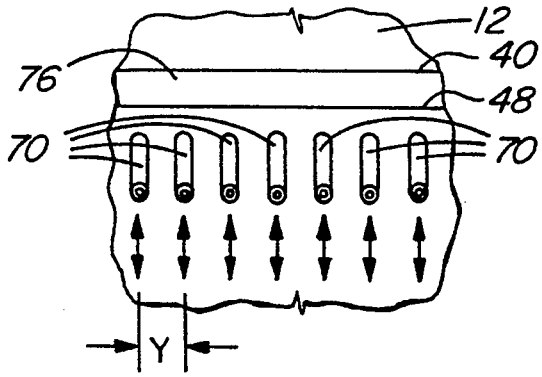
FIG. 5 is a view looking in the direction of the arrow 5 in FIG. 4, showing the various passages in use to regulate flow.

In the arrangement shown in FIGS. 4 and 5, the bleed holes 56 have been replaced with tubes 70 each having valves as indicated at 72 and through which the coating fluid may either be pumped into the chamber 24 or simply discharged from the chamber as indicated by the arrow 74.

As with the previous embodiment, the distance from the inlet (outlet) 75 of the tubes 70 and the metering outlet 26 must be such that any disturbance caused by the flow of fluid into or from the tubes 70 disrupts the flow in the chamber 24 and this disruption is carried downstream to and through the outlet 26.

In the FIGS. 4 and 5 embodiment it is preferred that the edge 48 of the wall 46 or blade 52 be spaced from the surface 40 (or web 15 not shown in FIGS. 4 and 6) to provide a gap as indicated at 76 for bleed of coating fluid to form the required seal at the upstream edge of the outlet 50.

Figure 6:
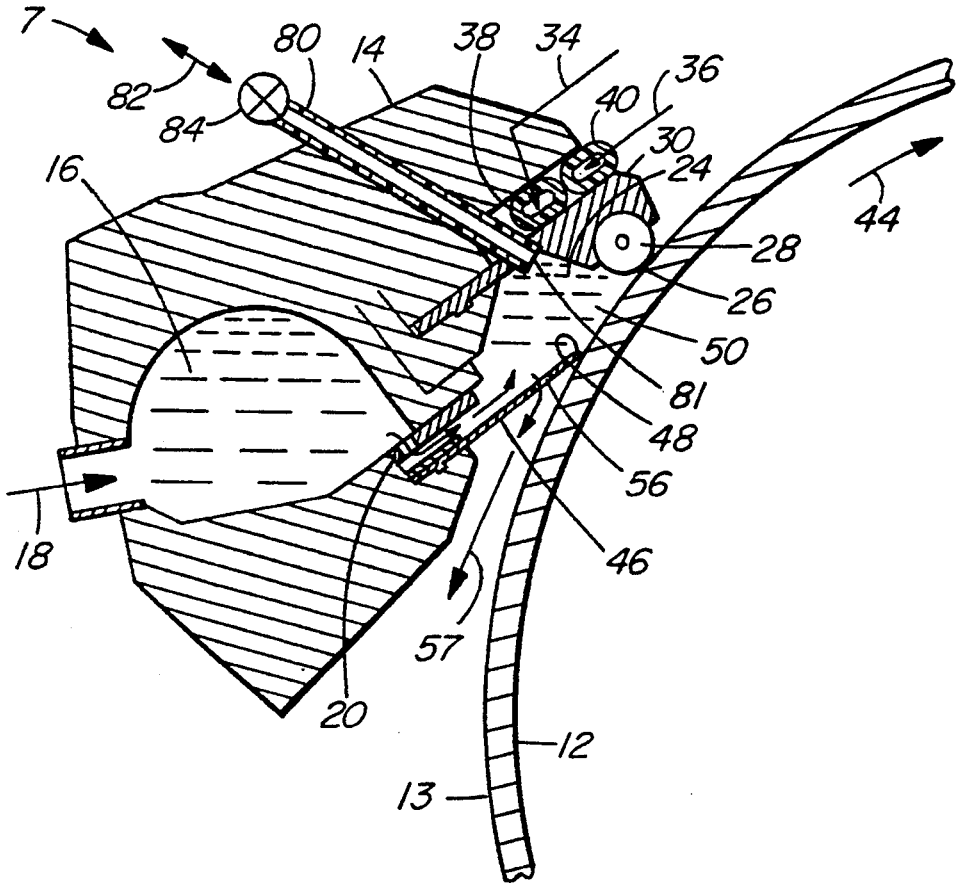
FIG. 6 is a view similar to FIG. 1 but showing a further modification of the present invention.
Figure 7:
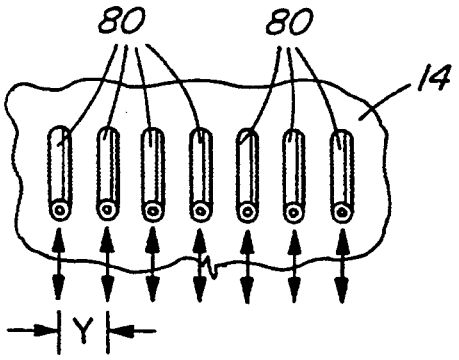
FIG. 7 is a partial view looking in the direction of the arrow 7 in FIG. 6.

In the arrangement shown in FIGS. 6 and 7, the bleed arrangement through the back or upstream wall 46 to permit the flow of coating as indicated by the arrows 57 and form the seal (as above described) may be the same as described above with respect to any of FIGS. 1, 2, 4 or 5. A plurality of conduits as indicated at 80 is provided through the wall of the housing 14 into the chamber 24 close to the rod 28 and its holder 30 to direct flow of coating either into or out of the chamber 24. The inlets or outlets 81 of the conduits 80 are positioned within the above described distance X from the outlet 26, so that any flow disturbances caused by the withdrawal or input of coating fluid through the lines 80 as indicated by the arrows 82 and valve 84 are reflected in the local flow through the gap 26.

There are a number of conduits or pipes 80 uniformly spaced axially relative to the drum 12 so that by selectively locally adjusting the flow through these conduits 80 the profile of the coating, i.e. the local coat weight (amount of coating) passing through the metering outlet 26 may be adjusted to adjust locally the amount of coating applied to the paper.

The spacing Y between the conduits 80 or 70 (the conduits 70 and 80 may be spaced axially of the drum 12 by essentially the same amount) should be at least about 1 inch and preferably no greater than about 6 inches and the size of these conduits normally will be about ¼ to 1 inch inside diameter or equivalent (round cross-section conduits are not essential).

In a specific application of the invention, a distance of about 3 inches was satisfactory X for flows under fluid pressures of about 1 to 5 psi in chamber 24 with a coating viscosity of 300–1200 cps.

Figure 8:
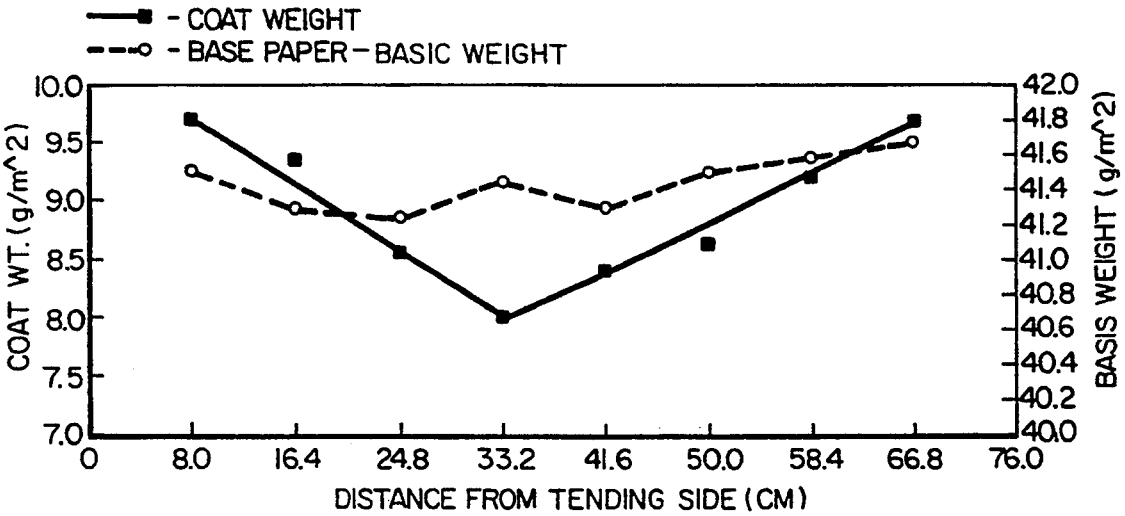
FIG. 8 is a plot of coat weight applied when a bleed across the coater was used, varied from a maximum in the middle to a minimum at the end.
Figure 8A:
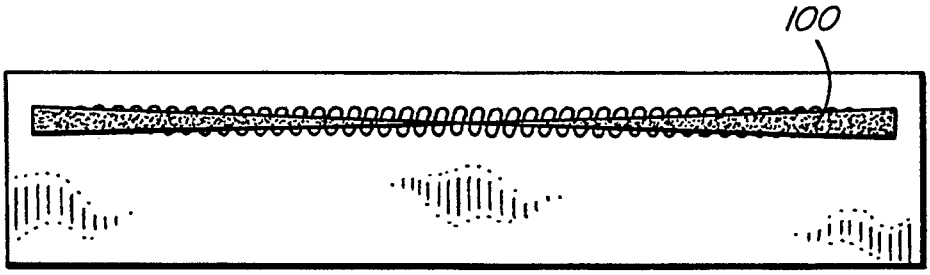
FIG. 8A is a schematic illustration of the manner in which the bleed holes were blocked off to obtain the plot of FIG. 8.

FIG. 8 shows a plot of the results obtained in an experiment using the apparatus as shown in FIGS. 1 and 2 but wherein the outlet holes 56 were masked as illustrated by the shaded area 100 in FIG. 8A.

It can be seen from FIG. 8 that the coat weight applied increases in proportion to the area of the slots 56 that are masked to inhibit flow. The greater the area masked in, the smaller the area of the bleed hole, the larger the coat weight applied immediately downstream thereof.

Having described the invention, modifications will be evident to those skilled in the art without departing from the scope of the invention as defined in the appended claims.

We claim:

1. A coating applicator for applying a coating fluid to a moving surface, said applicator comprising a chamber, an inlet to said chamber for introducing said coating fluid into said chamber, a first outlet from said chamber opening towards said surface, said surface obstructing said first outlet and moving in a direction of movement relative to said first outlet from an upstream end of said first outlet to a downstream end of said first outlet, an outlet passage at said downstream end of said first outlet, a metering means defining one side of said outlet passage, local flow disturbing means for locally disturbing fluid flow at locations spaced transversely of said chamber relative to said direction of movement, means for selectively locally adjusting said flow disturbing means to locally selectively change fluid flow in said chamber at selected locations spaced transversely of said surface, said local flow disturbing means positioned upstream of said metering means in a direction of coating fluid flow toward said metering means by a distance sufficiently short that local disturbances in flow in said chamber caused by said local flow disturbing means are not dissipated before said coating flows from said chamber past said metering means and the amount of coating fluid passing through said outlet passage is locally selectively adjusted at spaced location transverse of said surface.

2. An applicator as defined in claim 1 further including a bleed outlet at said upstream end of said first outlet, said bleed outlet permitting flow rearward relative to said direction of movement of said surface past said applicator to form an air seal at said upstream end of said first outlet to inhibit entrainment of air into said first outlet.

3. An applicator as defined in claim 2 wherein said bleed outlet is formed between said surface and an upstream wall at said upstream end of said first outlet.

4. An applicator as defined in claim 1 wherein said local flow disturbing means is formed by a plurality of fluid flow passages opening into said chamber at spaced location across the width of said chamber and said means for selectively locally adjusting said flow disturbing means selectively adjusts flow through said passages.

5. An applicator as defined in claim 2 wherein said local flow disturbing means is formed by a plurality of fluid flow passages opening into said chamber at spaced location across the width of said chamber and said means for selectively locally adjusting said flow disturbing means selectively adjusts flow through said passages.

6. An applicator as defined in claim 3 wherein said local flow disturbing means is formed by a plurality of fluid flow passages opening into said chamber at spaced location across the width of said chamber and said means for selectively locally adjusting said flow disturbing means selectively adjusts flow through said passages.

7. An applicator as defined in claim 5 wherein said bleed outlet and said fluid flow passages are formed in said upstream wall.

8. An applicator as defined in claim 6 wherein said bleed outlet and said fluid flow passages are formed in said upstream wall.

9. A coating applicator for applying coating fluid to a moving surface said applicator comprising a chamber, an inlet for coating fluid into said chamber, a first outlet from said chamber opening to said surface, said surface moving from an upstream side of said first outlet to a downstream end of said first outlet, metering means defining an outlet passage at said downstream end of said first outlet, a bleed outlet means for bleeding coating from said chamber at locations across the width of said chamber, means for locally selectively adjusting the amount of said coating fluid flowing towards said metering means in said chamber at areas transversely spaced relative to said surface thereby to vary locally transversely of said surface the amount of fluid locally passing said metering means.

10. An applicator as defined in claim 9 wherein said means for locally selectively adjusting the amount of coating flowing toward said metering means comprises means to locally vary the size of said bleed outlet means and divert selected amounts of said coating fluid from said chamber through said bleed outlet means at spaced locations across said applicator.

* * * * *